United States Patent [19]

Endo et al.

[11] 4,259,424

[45] Mar. 31, 1981

[54] HEAT-DEVELOPABLE PHOTOSENSITIVE MATERIAL

[75] Inventors: Ichiro Endo, Yokohama; Hajime Kobayashi, Mitaka; Toshiyuki Komatsu, Kawasaki; Shigeru Ohno, Tokyo, all of Japan

[73] Assignee: Canon Kabushiki Kaisha, Tokyo, Japan

[21] Appl. No.: 9,591

[22] Filed: Feb. 5, 1979

Related U.S. Application Data

[63] Continuation of Ser. No. 831,923, Sep. 7, 1977, abandoned.

[30] Foreign Application Priority Data

Sep. 10, 1976 [JP] Japan ..... 51-108573

[51] Int. Cl.[3] ..... G03C 1/02; G03G 16/00

[52] U.S. Cl. ..... 430/48; 430/31; 430/49; 430/54; 430/62; 430/63; 430/64; 430/65; 430/348; 430/616; 430/617; 430/618; 430/619; 430/620; 250/316.1

[58] Field of Search ..... 96/114.1; 428/913; 250/316, 317; 430/31, 48, 49, 54, 62, 63, 64, 65, 348, 616, 617, 618, 619, 620

[56] References Cited

U.S. PATENT DOCUMENTS

| | | | |
|---|---|---|---|
| 3,328,167 | 6/1967 | Owen | 96/114.1 |
| 3,457,075 | 7/1969 | Morgan et al. | 96/114.1 |
| 3,951,664 | 4/1976 | Von Konig | 96/66 T |
| 4,009,039 | 2/1977 | Masuda | 96/114.1 |
| 4,013,473 | 3/1977 | Willems et al. | 96/114.1 |
| 4,057,016 | 11/1977 | Endo et al. | 96/1 R |
| 4,069,759 | 1/1978 | Endo et al. | 96/114.1 |
| 4,120,722 | 10/1978 | Okamoto et al. | 96/114.1 |

FOREIGN PATENT DOCUMENTS

| | | | |
|---|---|---|---|
| 2702919 | 7/1977 | Fed. Rep. of Germany | 96/1 R |
| 2745696 | 4/1978 | Fed. Rep. of Germany | 96/1 |
| 119623 | 9/1975 | Japan | 96/114.1 |
| 1413288 | 11/1975 | United Kingdom | 96/114.1 |

OTHER PUBLICATIONS

Research Disclosure, Product Licensing Index Jun. 1972 pp. 68–70.

*Primary Examiner*—Mary F. Downey

*Attorney, Agent, or Firm*—Fitzpatrick, Cella, Harper & Scinto

[57] ABSTRACT

An improved heat-developable photosensitive material is disclosed which comprises an infrared rays-absorbing layer provided in contact with or adjacent to a layer comprising a reducible organic silver salt.

19 Claims, 1 Drawing Figure

HEAT-DEVELOPABLE PHOTOSENSITIVE MATERIAL

This is a continuation of application Ser. No. 831,923 filed Sept. 7, 1977 now abandoned.

BACKGROUND OF THE INVENTION

1. Field of the Invention

The present invention relates to an improved heat-developable photosensitive material having a photosensitive layer which contains in its binder a reducible organic silver salt being able to isolate silver from it by the action of energy externally applied thereto.

2. Description of the Prior Art

In the technical fields of information recording and printing, a rapid and remarkable advancement has been made in recent years in developing novel methods and materials used therefor which allow a simple and accurate recording and printing at a higher speed. Among them, for example, heat-developable photosensitive material has become one of the objects of particular attention in the art. Unlike the conventional photographic photosensitive material consisting essentially of inorganic silver salt, the novel heat-developable photosensitive material consisting essentially of organic silver salt as image forming agent does not necessitate any wet treatments, or developing and fixing after imagewise exposure. These novel types of photosensitive materials are, for example, disclosed in U.S. Pat. Nos. 3,457,075, 3,531,286 and 3,589,903 specifications.

These materials are usually formed by applying on a suitable support such as plastic film, plastic sheet or paper a photosensitive layer comprising an organic silver salt employing a suitable technique such as coating or immersion.

As mentioned above, the use of this type of material in forming an image has such merit that all the processes required to form an image may be carried out with dry treatments. In spite of such valuable advantage, however, there are still several problems to be solved in these novel materials.

In order to make it possible to obtain always high quality images, the uniformity in grade, distribution and selection of the every component substance of the photosensitive material as well as in quality of the produced material is of great importance. Moreover, it is required that, after formed, the material be hardly rendered to a change on standing.

Furthermore, there are other requirements related to the image forming process which such material should satisfy. These requirements are deduced from the fact that the novel material is heat-developable photosensitive material which is subjected to a heat-developing treatment after an imagewise exposure so as to form an image thereon. To carry out the heat-development, conduction heating means such as a pair of heating rollers is generally employed. Therefore, to produce a high quality image, the heat for heat-developing should be uniformly transmitted to all over the area of the heat-developable photosensitive material. On the other hand, the material per se must be a material of relatively high heat conductivity enough to allow the uniform transmission of heat for heat-developing. However, this can not be satisfied completely by the known heat-developable photosensitive materials. Usually, the heat-developable photosensitive material is in the form of a sheet comprising a support such as paper and a photosensitive layer applied thereon, which photosensitive layer is typically formed by dispersing in a suitable binder such as resin an organic silver salt as essential component. This structure of material often causes an irregular transmission of heat to be used for heat-developing the exposed material. Sometimes there is formed an unevenly developed image.

Speeding up the image forming process using the heat-developable photosensitive material is another problem. Since the heat-developing step is a rate-determining step in the image forming process, if a substantial speed up of the heat-development be attained, it will contribute to a great extent to the desired reduction in time necessary for the image forming process. But, it is difficult to realize that. When conduction heating means such as a pair of heating rollers is used for effecting heat-developing, some modifications of the heating means may be required to speed up the heat-development while keeping the heat conductivity of the heating means at a certain desired level. Firstly, in order to prevent the heating rollers from being cooled by the sheet of heat-developable photosensitive material passing through therebetween, it is required to enlarge the radius of the heating rollers so that the contact time with the sheet per one revolution may be shortened. Secondly, it is required to increase the calorific power of heat source such as electric heater mounted in the roller. These requirements will be satisfied only by a considerable enlargement in size of the heat-developing apparatus and a substantial increase in electric power consumption which are of course disadvantageous.

A further problem arises when such heat-developable photosensitive material is used for producing an electrostatic printing master disclosed in our prior application, U.S. Ser. No. 599,061. Namely, when various steps from a master forming step to an electrostatic printing step are carried out using such heat-developable photosensitive material in a continuous and automatic process and all the necessary treatments are carried out on a printing support such as drum, there may be caused some troubles by heat-developing with the conduction heating means. Like the above mentioned case, a considerable enlargement in size of the heat-developing apparatus and a substantial increase in electric power consumption are necessary to attain a speed up of the master forming step. Since the printing support such as drum on which the sheet of heat-developable photosensitive material is to be placed, is generally made of metal, the heat for effecting the heat-development is apt to dissipate in the printing support. As a result, the sheet of heat-developable photosensitive material is insufficiently heated so that there may occur insufficiency or irregularity in heat-developing. Moreover, even when a visible image of relatively good quality is produced, there may occur the case that the master formed therefrom lacks an adequate electrostatic characteristics which is essential for a good printing master. On the contrary, if a large amount of heat is supplied as to sufficiently heat-develop the sheet of heat-developable photosensitive material, there may be caused another trouble, apart from the disadvantage of the need of a greater amount of heat. The trouble is that the temperature of the printing support rises and thereby an elevation of the temperature of all the printing apparatus may be caused. This will adversely affect other parts or equipment such as the electric circuit parts.

A further problem involved in electrostatic printing using such master is found in the structure of the heating means. In order to obtain a maximum of efficiency of thermal conduction, the conduction heating means used in this printing process is usually the contact type which is brought into contact with the photosensitive sheet laid on the printing master during heat-development. At other stages of the process, in particular, during an electrostatic printing stage, the contact type of conduction heating means should be brought to a position apart from the photosensitive sheet so as to prevent the heating means from obstructing the electrostatic printing. Such conduction heating means makes the heat-developing apparatus equipped with it mechanically complicated and apt to get out of order. Moreover, it necessitates a considerable space for which the heating means moves from its contact position to its removed position and vice versa. This militates against the purpose of making the apparatus compact as a whole.

Under these conditions, it is concluded that an infrared heating means can be more effectively and more advantageously used as heat developing means, in particular, in performing the above described electrostatic printing. Compared with the known contact type of heating means, the infrared heating means which is of non-contact type has many advantages such as a high heat-developing efficiency, a capability of uniform heat-developing, a compact structure of apparatus and a relatively low consumption of heat.

However, there has not yet been proposed any heat-developably photosensitive material comprising reducible organic silver salt and having a good heat-developing property suitable for a heat-development employing infrared heating means.

SUMMARY OF THE INVENTION

Accordingly, it is the primary object of the invention to provide an improved heat-developable photosensitive material with an excellent heat-developing property which enables to use the heat-developing method employing infrared heating means and to derive the effect and advantage to the utmost extent from the method.

Another object of the invention is to provide an improved heat-developable photosensitive material which allows a uniform heating and a uniform conduction of heat over all the surface of the material during heat-developing and which has a high efficiency of heat-developing and does not cause any irregularity of images formed therefrom.

A further object of the invention is to provide an improved heat-developable photosensitive material which allows formation of a high quality image having a high resolving power and a high optical contrast.

Still a further object of the invention is to provide an improved heat-developable photosensitive material from which an electrostatic printing master having very excellent electrostatic printing properties may be formed.

According to an aspect of the present invention, there is provided a heat-developable photosensitive material which contains at least support having therein or in at least one layer thereon, (1) a reducible organic silver salt which isolates silver upon reduction, dispersed in a binder, (2) a reducing agent capable of reducing the organic silver salt of (1), and (3) a silver halide or halogen containing compound which reacts with the organic silver salt (1) to produce silver halide, and which is improved by means of infrared rays being employed for said heat development and of an infrared rays absorbing layer for absorbing said infrared rays and for generating heat therefrom to heat develop said material, said infrared rays absorbing layer being in contact with or adjacent to the reducible organic silver salt (1) dispersed in said binder.

According to another aspect of the present invention, there is provided a heat-developable photosensitive material for an electrostatic printing master which contains at least a support having therein or in at least one layer thereon, (1) a reducible organic silver salt which isolates silver upon reduction, dispersed in a binder, (2) a reducing agent capable of reducing the organic silver salt of (1), and (3) a silver halide or halogen containing compound which reacts with the organic silver salt (1) to produce silver halide, and which is improved by means of infrared rays being employed for said heat development and of an infrared rays absorbing layer for absorbing said infrared rays and for generating heat therefrom to heat develop said material, said infrared rays absorbing layer being in contact with or adjacent to the reducible organic silver salt (1) dispersed in said binder and being formed by dispersing an infrared rays absorbent in a resinous binder having a film forming ability.

Other and further objects, features and advantages of the present invention will appear more fully from the following description.

DESCRIPTION OF THE PREFERRED EMBODIMENT

Figure 1:
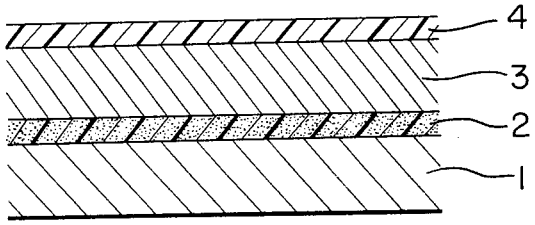
FIG. 1 is a cross-sectional view of a heat-developable photosensitive material according to the invention schematically showing the structure thereof.

All of the above described problems involved in known heat-developable photosensitive materials can be solved by the aforementioned structure of the heat-developable photosensitive material of the present invention and remarkable effects and advantages are attainable thereby.

Infrared rays relating to the invention are radiant rays of high thermal efficiency. The infrared rays-absorbing layer used in the invention is a layer capable of absorbing such infrared rays and generating heat as a result. In other words, the infrared rays-absorbing layer may be defined as a layer which has the function of converting light to heat. The infrared rays are not limitative and as mentioned above there may be used any radiant rays as far as they have a high thermal efficiency. But, infrared rays generally used for this purpose are those which have a wavelength in the range from the long wave side of visible rays (about $0.7\mu$) to $40\mu$. Preferably, infrared rays in the range of $0.7\mu$ to $30\mu$ are used. The most preferable range is from $0.75\mu$ to $15\mu$.

Basic structure of heat-developable photosensitive material of the present invention is illustrated in FIG. 1.

Reference numeral 1 designates a support, 2 is an infrared rays-absorbing layer, 3 is an organic silver salt-containing layer and 4 designates a surface layer.

The heat-developable photosensitive material shown in FIG. 1 is usually made in the following manner.

Infrared rays-absorbent is dispersed in a binder by the aid of suitable solvent. The dispersion thus prepared is applied onto a suitable support 1 which may be paper using a suitable coating means so as to form an infrared rays-absorbing layer 2 on the support 1. Thereafter, an organic silver salt, and a silver halide or a halogen-containing compound are dispersed in a suitable binder by the aid of suitable solvent and the dispersion thus prepared is overlaid on the layer 2 as to form an organic silver salt-containing layer 3. Further, onto the layer 3, there is coated a dispersion of a reducing agent so as to form a surface layer 4. The dispersion may be prepared by dispersing the reducing agent in a resinous binder such as cellulose acetate with the aid of a suitable solvent.

The infrared rays-absorbing layer 2 is generally so provided as to directly contact with the orgaic silver salt-containing layer 3. However, in order to transmit the heat to the layer 3 more efficiently and more uniformly, there may be provided an intermediate layer of good thermal conductivity between the layers 2 and 3.

In case that the heat-developable photosensitive material is to be that for electrostatic printing master, the intermediate layer is preferably formed as an electrically conductive layer. When the heat-developable photosensitive material is of the type to which infrared rays are irradiated from the side of the organic silver salt-containing layer 3, such intermediate layer should be infrared rays-transmissible as a master of course. On the contrary, when the heat-developable photosensitive material is of the type to which infrared rays are irradiated from the side of the support 1, it is recommendable that the intermediate layer is provided as an infrared rays-reflective layer of metal such as gold, silver or aluminum. In this case, since the irradiation of infrared rays to the heat-developable photosensitive material is carried out from the side of the support 1, the layer provided on the under side of the infrared rays-absorbing layer 2 (on the side of the support 1) should be a layer which allows a good transmission of the infrared rays therethrough.

The above mentioned infrared rays-reflective intermediate layer of metal serves to increase the amount of infrared rays absorbed by the infrared rays-absorbing layer 2. The intermediate reflective metal layer reflects those infrared rays which have not been absorbed by the layer 2 and passed through it, again into the layer so that the path length of the infrared rays may be doubled.

In case that the irradiation of infrared rays on the heat-developable photosensitive material is conducted from the side of the organic silver salt-containing layer 3 during a heat-development, the above described infrared rays-reflective intermediate layer of metal is provided on the side of the infrared rays-absorbing layer 2 opposite to the layer 3.

When the heat-developable photosensitive material of the invention is to be manufactured as that for an electrostatic printing master as described above, it is advisable that at least the surface area of the support 1 be made electrically conductive to obtain a further improved electrostatic printing properties, although the structure illustrated in FIG. 1 may be used for such material for a printing master.

To make the surface of the support 1 electrically conductive, various methods may be considered. As one example thereof, the support 1 per se may be made of metal such as nickel, stainless steel, aluminum, copper or chromium. As another example, the surface of the support 1 made of paper, plastic film or plastic sheet may be treated with a suitable electrically conductive material so as to give to the surface the desired electrical conductivity.

The electrical conductivity treatment to the support 1 is generally conducted on the surface thereof facing the infrared rays-absorbing layer 2. But, for the support made of material having a relatively high gas permeability such as paper, the treatment is preferably conducted on the surface of the support on the side opposite to the infrared rays-absorbing layer 2. For example, when an art paper coated on both sides is used as a support 1, the treatment may be carried out by coating the one side surface of the paper with an electrically conductive dispersion. The coating dispersion is prepared, for example, by dispersing an electrically conductive powder such as carbon powder in an electrically conductive polymer binder. By treating the support in this manner, the heat-developable material can be further improved in respect to its heat-developing property and electrostatic printing property.

When an intermediate layer is provided as a layer of infrared rays-reflective metal as described above, such intermediate layer serves also as an electrically conductive layer. Therefore, a better result can be obtained by providing the intermediate layer on the infrared rays-absorbing layer 2 at the side facing the support 1.

The infrared rays-absorbing layer 2 used in forming the heat-developable photosensitive material of the invention is composed essentially of an infrared rays-absorbent and a binder. The mixing ratio of the two main components may be determined in accordance of the object for which the heat-developable photosensitive material of the invention is used. Generally speaking, 0.001–100 parts by weight of binder is used to 1 part of infrared rays-absorbent. A preferable range of the mixing ratio is 0.01–10 parts of binder per 1 part of infrared rays-absorbent. While the particle size of infrared rays-absorbent may vary as desired, the average particle size in the range of from 0.001 to 10$\mu$, in particular, from 0.01 to 5$\mu$ is generally preferable. Also, the thickness of the infrared rays-absorbing layer 2 may vary as desired and generally a thickness in the range of from 0.5 to 30$\mu$ is used. But, the range of from 1 to 15$\mu$ is preferable and the most preferable range is from 1 to 10$\mu$.

The infrared rays-absorbent used in the present invention is by no means limitative, but any kind of absorbent may be used in the invention so far as it is able to absorb infrared rays and generate heat thereby, and to contribute, as a result, to the heat-development.

Organic pigments, inorganic pigments, carbon blacks, charcoals and dyes are effectively used as infrared rays-absorbent within the scope of the invention.

The followings are typical examples thereof. Inorganic pigments:

Cadmium sulfide, sulfur, selenium, zinc sulfide, cadmium sulfoselenide, chrome yellow, zinc chromate, molybdenum red, Guignets green, red iron oxide, green chromium oxide, red lead, cobalt oxide, barium titanate, titanium yellow, black iron oxide, litharge, iron blue, cadmium red, silver sulfide, lead sulfide, barium sulfate, ultramarine blue, calcium carbonate, magnesium carbonate, white lead, cobalt violet, loess, cobalt blue and emerald green.

Organic pigments:

(a) Insoluble azo-pigments (naphthol system); Brilliant Carmine BS, Lake Carmine F, Brilliant Fast Scarlet, Lake Red 4R (Pigment Red 3, 12120), Para Red (Pigment Red 1, 12070), Permanent Red, Fast Red FGR, Lake Bordeaux 5B, Bar Million No. 1 and-No. 2, and Toluidine Maroon (Pigment Red 18, 12350).

(b) Insoluble azo-pigments (anilide system); Diazo Yellow, Fast Yellow G, Fast Yellow 10G, Diazo Orange, Vulcan Orange and Pyrazolon Red (Pigment Red 38, 21120).

(c) Soluble azo-pigments; Lake Orange, Brilliant Carmine 3B (Pigment Red 60, 16105), Brilliant Carmine 6B (Pigment Red 57, 15850), Brilliant Scarlet G (Pigment Red 64, 15800), Lake Red C (Pigment Red 53, 15585) and-D (Pigment Red 50, 15500) and-R, Watchung Red (Pigment Red 48, 15865), Lake Bordeaux 10B, Bon Maroon L (Pigment Red 63, 15880) and-M.

(d) Phthalocyanine pigments; Phthalocyanine Blue (Pigment Blue 15, 74160), Fast Sky Blue (Pigment Blue 17, 74180 74200), and Phthalocyanine Green (Pigment Green 7, 74260).

(e) Lake pigments; Yellow Lake, Eosine Lake (Pigment Red 90, 45380), Rose Lake, Violet Lake, Blue Lake, Green Lake, and Sepia Lake.

(f) Movdant dyes; Alizarine Lake and Madder Carmine.

(g) Vat dyes; Indanthrene and Fast Blue Lake (GGS).

(h) Basic dye lake; Phodamine Lake (Pigment Violet 1, 45170) and Malachite Green Lake (Pigment Green 4, 42000).

(i) Acid dye lake; Fast Sky Blue (Pigment Blue 17, 74180 74200), Quinoline Yellow Lake (Pigment Yellow 47005), Quinacridone and Dioxazine.

Carbon blacks:

Furnace carbon blacks for rubber such as Super Abrasion Furnace, Intermediate Super Abrasion Furnace, High Abrasion Furnace, Fine Furnace, Fast Extruding Furnace, Medium Abrasion Furnace, High Modulus Furnace, General Purpose Furnace, All Purpose Furnace, Semi Reinforcing Furnace, Multi Purpose Furnace, Extra Conductive Furnace, Super Conductive Furnace and Conductive Furnace; carbon blacks for thermal cracking rubber such as Medium Thermal and Fine Thermal; carbon blacks for electric cell such as acetylene black; carbon blacks for channel rubber such as High Processing Channel, Medium Processing Channel, Easy Processing Channel and Conductive Processing Channel; channel carbon blacks for black color such as High Color Channel, Medium Color Channel, Long Flow Impingement and Low Color Channel; and lamp carbon blacks.

Charcoals:

Decolorizing charcoal, activated charcoal and the like.

Dyes:

A large number of dyes are known and almost all of them may be used in the invention. Typical examples thereof are as follows.

(a) Thiazine dyes such as methylene blue (Basic Blue 9, 52015), thionine, methylene blue D and methylene green E (Basic Green 5, 52020);

(b) Acridine dyes such as acridine orange (Basic Orange 14, 46005), proflavine and acriflavine;

(c) Xanthene dyes such as eosine (Acid Red 87, 45380), erythrocin (Acid Red 51, 45430), Rose Benzale, fluoresceine (Acid Yellow 73, 45350), rhodamine B (Basic Violet 10, 45170), phloxinde (Acid Red 98, 45405) and uranine;

(d) Oxazine dyes such as meldra blue and Nile blue A (913);

(e) Azine dyes such as riboflavin;

(f) Triphenyl methane dyes such as Malachite green (Basic Green 4, 42000), fuchsine (Basic Violet 14, 42510), methyl violet (Basic Violet 1, 42535), crystal violet (Basic Violet 3, 42555), ethyl violet and Victria blue (Basic Blue 26, 44045);

(g) Azo dyes such as naphthol blue, cris-amine G and alizarine yellow;

(h) Anthraquinone dyes such as alizarine (Mordant Red 11, 58000), alizarine rubinol (Acid Red 80, 68215) and eriochrome grey AB (Mordant Black 13, 63615);

(i) Diphenylmethane dyes such as auramine (Basic Yellow 2, 41000);

(j) Cyanine dyes such as 3,3'-diethyl-2,2'-thiacarbocyanine iodide;

(k) Styryl dyes such as 2-(p-dimethylaminostyryl)-3-ethyl benzothiazolium iodide; and (l) Mercocyanine dyes such as 3-ethyl-5[2-(3-ethyl-2-benzothiazolylidene)-ethylidene]rhodanine.

The infrared rays absorbent as mentioned above should be selected and used in accordance with the purpose of using the produced heat-developable photosensitive material. First, when a heat-developable photosensitive material is used as a material for forming directly thereon a visible image, that is, a material for copying, an infrared rays absorbent should be selected so as not to produce a color in the infrared rays-absorbing layer itself formed between the support and the organic silver salt containing layer. The reason for this is that if a color, particularly black is produced in the infrared rays-absorbing layer, it becomes difficult to distinguish an image from the background in case that the organic silver salt-containing layer is considerably thin since the visible image formed is a silver image.

Secondary, when the heat-developable photosensitive material is used for an electrostatic printing master, it is not necessary to take the above-mentioned matter into consideration. In this case, a silver image formed on the matter is a pattern capable of forming an electrostatic latent image and does not need distinguishing visiby at all from the background. Therefore, it is not a problem whether the infrared rays-absorbing layer itself is colored or not. However, in view of the infrared rays-absorbing efficiency, an infrared rays absorbent colored in black or black like tone is preferably used. Particularly, among the aforementioned infrared rays absorbent, carbon black and charcoal are optimum.

As the binder for forming the infrared rays-absorbing layer, any conventional binder may be used in the present invention as far as it has an adequate film forming ability. In particular, the preferred binder is a resinous one.

Examples of the resinous binder preferably used in the invention include: polyvinyl chloride, polyvinyl acetate, vinyl chloride-vinyl acetate copolymer, polyvinyl butyral, polystyrene, polymethyl methacrylate, polyurethane rubber, xylene resin, benzyl cellulose, ethyl cellulose, cellulose acetate butylate, cellulose acetate, polyvinylidene chloride, chlorinated polypropylene, polyvinyl pyrrolidone, cellulose propionate, polyvinyl formal, cellulose acetate phthalate, polycarbonate, cellulose acetate propionate, gelatin and derivatives thereof, acrylamide polymer, chlorinated rubber, polyisobutylene, butadiene-styrene copolymer and polyvinyl alcohol. Furthermore, photo-setting type resins such as urethanated acrylic resin may be advantageously used because such resin can be cured by exposing it to light after coating on the surface of a layer such as support employing a convenient coating method such as dipping.

Also, fatty acids having the general formula, R-COOH and their metal salts may be used as binder within the scope of the invention. In such general formula, R is a straight chain saturated $C_{10}$–$C_{31}$ alkyl group or a straight chain unsaturated $C_3$-$C_{21}$ alkyl group. Typical examples thereof preferably used include: undecyclic acid, lauric acid, tridecylic acid, myristic acid, pentadecylic acid, stearic acid, nonadecanoic acid, arachic acid, behenic acid, lignoceric acid, cerotic acid, heptacosanoic acid, montanic acid, melissic acid, lacceric acid, crotonic acid, elaidic acid, oleic acid, cetaoleic acid, erucic acid, brassidic acid, sorbic acid, stearolic acid and tariric acid.

As the metal salts of the above defined fatty acids, those salts of the above mentioned fatty acids with metal such as Zn, Co, Fe, Me, Cu, Ni, Cr, Pb, Ca, Al, Zr, Na and K are preferably used.

The above described binders may be used alone or in the two or more combination thereof.

In order to improve the stability adhesion, film forming propery and the like of the infrared rays-absorbing layer 2, there may be advantageously added suitable additive(s) such as high molecular compound plasticizer when used.

As previously described, the organic silver salt-containing layer is formed by dispersing mainly a reducible organic silver salt in a suitable binder.

The reducible organic silver salt is a main supplying source of metallic silver used for foming silver grain images. The binder has to be selected from the above mentioned resinous binder materials so as to have a film forming ability sufficient enough to form the organic silver salt-containing layer and to serve also as a dispersion medium useful for dispersing the organic silver salt and other ingredients uniformly in the layer. Moreover, when the heat-developable photosensitive material is to be used as that for electrostatic printing master, the binder has to be selected from electrically insulating material. This is because in this case it is required for the binder to impart an electrostatic charge retentivity to the non-silver grain image portion of the printing master. By doing so, it is made possible to produce electrostatic latent images having a high electrostatic potential contract sufficient for practical purpose when the printing master having thereon silver grain images are electrically charged.

In addition to the reducible organic silver salt, there may be incorporated a halide, a reducing agent and others to the organic silver salt containing layer so as to achieve the above-mentioned objects.

The halide is added so as to impart photosensitivity to the heat-developable photosensitive material and the reducing agent is added for the purpose of reducing the organic silver salt to isolate metallic silver when heat-development is carried out for forming the silver grain images.

The reducing agent maybe directly dispersed in the organic silver salt-containing layer, and alternatively, the reducing agent may be applied in the form of a layer, for example, by mixing the reducing agent with a film-shapable resinous binder such as cellulose acetate in an appropriate solvent and applying the resulting mixture to a surface of the organic silver salt-containing layer to form a reducing agent-containing layer.

However, in case of producing the reducing agent-containing layer on an organic silver salt-containing layer, it is desirable that a sufficiently thin reducing agent-containing layer is formed, or the film-shapable binder for the reducing agent-containing layer is made of a material which can not or hardly retain electrostatic charge. Otherwise, the surface of the reducing agent-containng layer may be uniformly charged and thereby electrostatic latent images may be hardly produced because of the electrostatic charge retentivity of the binder being too large.

Representative reducible organic silver salts used in the present invention are silver salts of organic acids mercapto compounds and imino compounds and organic silver complex salts. Among them, silver salts of organic acids, in particular, silver salts of fatty acids are preferable.

Typical examples of organic silver salts are as follows:

1. Silver salts of organic acids
   (1) Silver salts of fatty acids
      (1) Silver salts of saturated aliphatic carboxylic acids: silver acetate, silver propionate, silver butyrate, silver velerate, silver caproate, silver enanthate, silver caprylate, silver pelargonate, silver caprate, silver undecylate, silver laurate, silver tridecylate, silver myristate, silver pentadecylate, silver palmitate, silver heptadeylate, silver stearate, silver nonadecylate, silver archidate, silver behenate, silver lignocerate, silver cerotate, silver heptacosanate, silver montanate, silver melissinate, silver laccerate, and the like.
      (2) Silver salts of unsaturated aliphatic carboxylic acids: silver acrylate, silver crotonate, silver 3-hexenate silver 2-octenate, silver oleate, silver 4-tetradecenate, silver stearolate, silver docosenate, silver behenolate, silver 9-undecyanate, silver arachidonate, and the like.
      (3) Silver salts of aliphatic dicarboxylic acids: silver oxalate and the like.
      (4) Silver salts of hydroxycarboxylic acids: silver hydroxystearate and the like.
   (2) Silver salts of aromatic carboxylic acids
      (1) Silver salts of aromatic carboxylic acids: silver benzoate, silver o-aminobenzoate, silver p-nitrobenzoate, silver phenylbenzoate, silver acetoamidobenzoate, silver salicylate, silver picolinate, silver 4-n-octadecyloxydiphenyl-4-carboxylate and the like.
      (2) Silver salts of aromatic dicarboxylic acids; silver phthalate, silver quinolinate and the like.
   (3) Silver salts of thiocarboxylic acids silver, $\alpha,\alpha'$-dithiodipropionate, silver $\beta,\beta'$-dithiodipropionate, silver thiobenzoate and thelike.
   (4) Silver salts of sulfonic acids silver p-toluenesulfonate, silver dodecylbenzensulfonate, silver taurinate and the like.
   (5) Silver sulfinates silver p-acetoaminobenzensulfinate and the like.
   (6) Silver carbamates silver diethyldithiocarbamate and the like.
2. Silver salts of mercapto compounds
   silver 2-mercaptobenzoxazole, silver 2-mercaptobenzothiazole, silver 2-mercaptobenzimidazole, and the like.
3. Silver sats of imino compounds
   silver 1,2,4-triazole, silver benzimidazole, silver benztriazole, silver 5-nitrobenzimidazole, silver 5-nitrobenztriazole, silver o-sulfobenzimide, and the like.
4. Organic silver complex salts
   silver di-8-hydroxyquinoline, silver phtharazone, and the like.

The function of the reducing agent in the present invention is described above in detail.

Representative reducing agents are organic reducing agents such as phenols, bisphenols, napthols, di- or polyhydroxybenzenes and the like.

Typical reducing agents are as shown below.

(1) Phenols:
aminophenol, 2,6-di-t-butyl-p-cresol, p-methylaminophenol sulfate (metol), and the like.

(2) Bisphenols:
2,2'-methylene bis(6-t-butyl-4-methylphenol),
4,4'-butylidene bis(6-t-butyl-3-methylphenol),
4,4'-bis(6-t-butyl-3-methylphenol),
4,4'-thio bis(6-t-butyl-2-methylphenol),
2,2'-methylene bis(6-t-butyl-4-ethylphenol), and the like.

(3) Naphthols
2,2'-dihydroxy-1,1'-binaphthyl,
6,6'-dibromo-2,2'-dihydroxy-1,1'-binaphthyl,
bis(2-hydroxy-1-naphthyl) methane, methylhydroxynaphthalene, and the like.

(4) Di- or polyhydroxybenzenes
hydroquinone, methylhydroquinone, chlorohydroquinone, bromohydroquinone, pyrogallol, catechol and the like.

(5) Others
1-phenyl-3-pyrazolidone (phenidone) and the like.

The reducing agents may be used in combination, if desired.

Among the above mentioned reducing agents, phenols, bisphenols are preferable, and bisphenols are more preferable.

The amount of the reducing agent is appropriately determined depending upon the desired characteristics of the heat-developable photosensitive material. Usually it is not more than 5 moles, preferably not more than one mole, more preferably $1-10^{-5}$ mole per mole of the organic silver salt.

Halides used in the present invention may be silver halides and halogen-containing compounds including inorganic halides other than silver halides and halogen-containing organic compounds.

Representative halides are as follows:

(1) Silver halides:
silver chlorobromide, silver chlorobromoiodide, silver bromoiodide and silver chloroiodide.

(2) Inorganic halides:
Preferable inorganic halides are those having the formula $$MXm$$

where in X is halogen such as Cl, Br and I, and M is hydrogen, ammonium, or metal such as potassium, sodium, lithium, calcium, strontium, cadmium, chromium, rubidium, copper, nickel, magnesium, zinc, lead, platinum, palladium, bismuth, thallium, ruthenium, gallium, indium, rhodium, beryllium, cobalt, mercury, barium, cesium, lanthanium, iridium, and aluminum, and m is 1 where M is halogen or ammonium and where M is a metal m means the valency of the metal.

(3) Halogen-containing organic compounds:
carbon tetrachloride, chloroform, trichloroethylene, triphenyl methyl chloride, triphenyl methyl bromide, iodoform, bromoform, cetylethyl dimethyl ammonium bromide and the like.

The mechanism of function of the halides are not yet clear, but among the above-mentioned halides, the mechanism as to silver halides is considered as follows. Exposure causes formation of isolated silver and the resulting silver functions as developing nucleus upon heat-development and accelerates isolation of silver from the reducible organic silver salt to produce silver grain images.

With respect to the halides other than silver halides, such halides seem to react with the reducible organic silver salts to produce silver halides and then silver is isolated from the silver halides in a manner as mentioned above and works as developing nucleus to produce silver grain images.

The above mentioned halides may be used alone or in combination.

It is desirable that the amount of the halide be as small as possible, provided that it gives a minimum photosensitivity necessary to form images upon imagewise exposure, in other words, the amount of the halide be a minimum amount enough to produce developing nucleus capable of conducting heat-development.

When the halide is added in an amount over the necessary amount as mentioned above, silver halides which are photosensitive remain in the material and thereby photosensitivity of the material becomes unnecessarily so high that the material should be stored or handled with an extensive care not to expose the material to even a small quantity of light. Otherwise the material is subjected to color change and so-called fog is formed.

On the contrary, when the amount of the halide is less than that necessary, there can not be formed a sufficient amount of developing nucleus for heat-developing efficiency.

Taking such limitations into consideration, the amount of the halide is usually $1-10^{-6}$ mole, preferably $10^{-1}-10^{-6}$ mole, more preferably $10^{-1}-10^{-5}$ mole per one mole of the organic silver salt.

The halide may be incorporated into the organic silver salt-containing layer. Further the halide may be incorporated into the reducing agent-containing layer. Still further, the halide may be incorporated into both the organic silver salt-containing layer and the reducing agent-containing layer. In addition, the halide may overlie the organic silver salt-containing layer in the form of a layer containing the halide.

As binder for forming the organic silver salt layer, there may be used resinous binders.

It is important that the resinous binder has a film-shapability and is not softened over a certain limit upon heat-development to avoid undue lowering of the binding property. In particular, the latter characteristic is very important because the softening of the binder results in deformation of the image when heat-development is effected with a heating roller. Further, it is preferred that upon heat-development after the formation of latent images by imagewise exposure, the binder does not suppress isolation of silver from the reducible organic silver salt, and positively accelerate the isolation of silver from the reducible organic silver salt at the exposed portions. Since the electrostatic printing methods using the electrostatic printing master produced from the heat-developable photosensitive material are based on electrostatic potential contrast between unexposed portions (non-silver grain image portions) and exposed portions (silver grain image portions) obtained by charging the surface of the master by corona discharging or the like, it is very important also in case of the heat-developable photosensitive material for electrostatic master that electrostatic charge is retained as much as possible at the unexposed portions while electrostatic charge is not retained as far as possible at the exposed portions. Therefore, the binder should have a specific resistance capable of retaining electrostatic charge.

The specific resistance of the binder is usually $10^{10}$ ohm·cm or more, preferably $10^{11}$ ohm·cm or more preferably $10^{13}$ ohm·cm or more.

For the purpose of preventing formation of dielectric breakdown or pinholes at unexpoesed portions upon charging, it is necessary to select the dielectric breakdown strength of the binder depending upon degree of charging given by corona discharging and the like. The dielectric breakdown strength is usually 10 KV/mm or more, preferably 15 KV/mm or more and preferably 20 KV/mm or more.

In addition, it is preferable, that the binder has a high moisture resistance. When the electrostatic printing master is used in a highly humid atmosphere, lack of moisture resistance results in lowering of the electric resistance at the unexposed portions and thereby lowering of electrostatic potential contrast. Further, electrostatic charge flows to the surface direction of the master. Therefore, moisture resistance of the binder should be appropriately selected depending upon humidity and environment where the master is used. The moisture resistance is preferably such that the equilibrium moisture content is not more than 3.0%, preferred with not more than 2.0% at a relative humidity of 20–100%.

Representative binders are as follows:

polyvinyl butyral, polyvinyl acetate, cellulose diacetate, cellulose triacetate, cellulose acetate butyrate, polyvinyl alcohol, ethyl cellulose, methyl cellulose, benzyl cellulose, polyvinyl acetal, cellulose propionate, cellulose acetate propionate, hydroxyethyl cellulose, ethylhydroxy cellulose, carboxymethyl cellulose, polyvinyl formal, polyvinyl methyl ether, styrene-butadiene copolymer, polymethyl methacrylate and the like. These binders may be used alone or in combination.

The amount of the binder in the organic silver salt-containing layer is usually 0.02–20 parts by weight, preferably 0.1–5 parts by weight per one part by weight of the reducible organic silver salt. The above-mentioned polymers as a binder have different chemical and physical properties depending upon the polymerization condition so that it is necessary to select such polymers as suitable for the purpose of the present invention. For example, when the binder is polyvinyl butyral, such a polyvinyl butyral having averaged degree of polymerization of 500–1000, degree of butyralation of at least 60 mole % and residual acetyl group of not exceeding 3 mole %, is preferable.

As the solvents for dispersing the reducible organic silver salt in an binder, there may be used methylene chloride, chloroform, dichloroethane, 1,1,2-trichloroethane, trichloroethylene, tetrachloroethane, carbon tetrachloride, 1,2-dichloropropane, 1,1,1-trichloroethane, tetrachloroethylene, ethyl acetate, butyl acetate, isoamyl acetate, cellosolve acetate, toluene, xylene, acetone, methyl ethyl ketone, dioxane, tetrahydrofuran, dimethylamide, N-methylpyrrolidone, alcohols such as methyl alcohol, ethyl alcohol, isopropyl alcohol, butyl alcohol and the like, and water.

The organic silver salt-containing layer may be produced by dispersing the reducible organic silver salt in the binder by using a solvent and coating the resulting dispersion on the support. The coating procedure may be carried out by known techniques for producing a thin film from a synthetic resin such as rotating coating method, air-knife coating method, wire-bar coating method, flow-coating method and the like. The thickness of the layer may be optionally controlled.

To the heat-developable photosensitive material according to the present invention, there may be added an aggregation accelerator for metallic silver upon heat-developing, a toning agent for controlling color tone of the resulting image, a stabilizer for images for a long time of storage, a light resistant agent capable of preventing a formation of fog during storing the material before using and preventing deterioration of formed images due to fog after forming the images, a dye sensitizer, a developing accelerator and the like, in an amount necessary for each agent in accordance with the characteristics of the heat-developable photosensitive material.

If desired, a plasticizer may be added to the heat-developable photosensitive material according to the present invention.

Representative plasticizers are dioctyl phthalate, tricresyl phosphate, diphenyl chloride, methyl naphthalene, p-terphenyl, diphenyl and the like.

As mentioned above, the heat-developable photosensitive material according to the present invention comprises a support, an infrared rays-absorbing layer and an organic silver salt-containing layer and if desired, other layer(s) on the support, and the thickness of the total layers on the support is usually 1–50 microns preferred with 2–30 microns.

The support may be a metal plate such as aluminum, copper, zinc, silver and the like, a metal laminated paper, a paper treated to prevent permeation of solvent, a paper treated with a conductive polymer, a synthetic resin film containing a surface active agent, a glass paper, synthetic resin, film and the like having on the surface a vapor-deposited metal, metal oxide or metal halide. Further, there may be used an insulating glass, paper, synthetic resin and the like. In particular, a flexible metal sheet, paper or other conductive materials which can be wound on a drum are preferable.

When a coated paper having a terra alba coating on a wood free paper is used as the support, there can be obtained a heat-developable photosensitive material capable of producing an electrostatic printing master having excellent electrostatic and mechanical characteristics. It is considered that this is attributable to the fact that the coating paper allows the coating material to permeate the paper at an appropriate degree upon producing the coating layers such as the organic silver salt layer. As a result, there is formed an electrostatic printing master having a uniform electrostatic potential contrast, a high mechanical strength and an excellent durability.

The most general electrostatic printing process employing the electrostatic printing master produced from the heat-developable photosensitive material according to the present invention comprises the steps of charging, developing and transferring. For example, the electrostatic printing master is passed through, for example, under a negative corona electrode and negative charge is given to the surface area of the non-silver image portions of the electrostatic printing master. In this case, a positive corona electrode or alternating current corona electrode may be used in place of the negative corona electrode. As the result, latent images (electrostatic charge patterns) are formed selectively on the non-silver image portions. The electrostatic images may be converted to toner images by known developing method such as cascade, magnetic brush, liquid, magnedry, water development and the like. When toner particles are not charged or charged with an electric charge opposite to that imparted to the electrostatic images, the toner particles attach to the electrostatically charged portions. Then, an image receiving member is brought into contact with the surface of the toner images and the toner images can be transferred to the image receiving member by, for example, applying a corona electrode of a polarity opposite to that of the toner particles from the back side of the image receiving member. The toner images thus transferred may be fixed according to known methods. Usually, heat fixation, solvent fixation and the like are used and in case of liquid development, only drying may be necessary. Further a pressure fixation may be employed. Toner particles remaining on the surface of the electrostatic printing master after transferring may be removed by a cleaning means such as brush, fur-brush, cloth, blade and the like to clean the surface of the master.

Electrostatic printing processes may be effected by repeating the cycle of charging, developing, transferring and cleaning, or repeating the cycle, utilizing durability of the electrostatic images, of developing, transferring and cleaning. The cleaning step may be omitted, if desired.

The present invention will be understood more readily by reference to the following examples. However, these examples are intended to demonstrate the invention and are not to be construed to limit the scope of the invention.

EXAMPLE 1

| | |
|---|---|
| Carbon black H A F (supplied by Cabot Co., trade name: Regal 400R) | 10 g |
| behenic acid | 20 g |
| methyl ethyl ketone | 200 g |

were mixed and milled by the ball milling method for 72 hours and the resultant slurry was coated onto the surface of an art paper by means of a coating rod (#24) followed by drying at 80° C. for five minutes. Thus, an infrared rays-absorbing layer 5μ thick was formed.

Besides the above, 25 g of silver behenate, 120 g of methyl ethyl ketone and 120 g of toluene were mixed and dispersed together by the ball milling method over 72 hours. To the resultant dispersion, there were added 100 g of polyvinyl butyral (as 10 percent by weight ethyl alcohol solution) and thoroughly mixed to form a homogeneous dispersion. To the resultant dispersion of organic silver salt in polymer, there were further added 200 mg of calcium bromide, 120 mg of mercury acetate and 2.5 g of phtharazinone and mixed together. Thereafter, the polymer dispersion was coated onto the above prepared infrared rays-absorbing layer by means of coating rod in the dark and dried. Thus, an organic silver salt-containing layer 8μ thick was formed.

To prepare a coating solution for a surface layer, 1.5 g of 2,2'-methylene-bis-(6-t-butyl-p-cresol), 0.3 g of phtharazinone, 10 g of cellulose acetate (as 10 wt% acetone solution) and 30 g of acetone were mixed together. This coating solution for surface layer was coated onto the above prepared organic silver salt-containing layer in the dark in the thickness of 4μ as dried. In this manner, a sample sheet of heat-developable photosensitive material according to the invention was prepared.

As a control, another sample sheet of heat-developable photosensitive material was prepared in the same manner as described above excepting that the infrared rays-absorbing layer was omitted.

These two photosensitive sheets were exposed to light through a positive image pattern employing a tungsten light source (2500 lux) for 12 seconds. Thereafter, developing was carried out to the exposed sheets by heatng for 5 seconds with an infrared heating apparatus of 600 W so as to obtain negative silver grain images. It was found that on the photosensitive sheet provided with the infrared rays-absorbing layer there was formed a very good image whereas another sample sheet having no infrared rays-absorbing layer produced only an image of low contrast. Since the poor contrast of the produced image was apparently attributable to an insufficiency of the heat-development, the photosensitive sheet sample of control was further heated with the same infrared heating apparatus so as to subject it to a strengthened heat-development. In this additional heat-developing, it was found that 10 seconds were additionally required until a good image with the almost same image characteristics as that of the image produced on the sheet having the infrared rays-absorbing layer could be obtained also on the sheet of control.

EXAMPLE 2

| | |
|---|---|
| Activated carbon powder(supplied by Kanto Kagaku Co.) | 10 g |
| ethyl cellulose | 10 g |
| ethanol | 100 g |

were mixed together for 72 hours by the ball milling method. The resultant slurry was coated on an art paper coated on both sides by means of a coating rod (#24) and dried at 80° C. for 5 minutes. Thus, an infrared rays-absorbing layer 3μ thick was formed.

Besides the above, 25 g of 50 mol% silver behenate, *1 120 g of methyl ethyl ketone and 120 g of toluene were mixed and dispersed together for a long time over 72 hours by the ball milling method.

*1 "50 mol%" means the value given by the following equation when behenic acid is substituted for organic acid.

$$\text{mol\% of silver salt of organic acid} = \frac{\left(\text{mol number of silver salt of organic acid}\right)}{\left(\text{mol number of organic acid}\right) + \left(\text{mol number of silver salt of organic acid}\right)} \times 100$$

To the resultant dispersion, there were added 100 g of polyvinyl butyral (as 10 wt% ethyl alcohol solution) and thoroughly mixed to form a homogeneous dispersion. To the dispersion thus prepared, there were further added 200 mg of calcium bromide, 120 mg of mercury acetate and 2.5 g of phtharazinone and mixed. This dispersion was then coated onto the above prepared infrared rays-absorbing layer in the same manner as in Example 1. Thus, an organic silver salt-containing layer was formed.

Thereafter, a coating solution for surface layer was prepared in the same manner as in Example 1 and the solution was coated onto the above formed organic silver salt-containing layer. In this manner, a sample sheet of heat-developable photosensitive material was produced.

The photosensitive sheet prepared above was mounted on a printing support which was a drum made of aluminum, and subjected to a master forming treatment in the same manner and under the same conditions as in Example 1. With the printing master thus formed, an electrostatic printing process was carried out in the following manner:

The master was uniformly charged with a corona discharge of +7 kV and a development with negatively charged toner was carried out by the magnet-brush method so as to produce a positive toner image. A transfer sheet of paper was overlaid on the toner image and then charged with the same corona discharge as described above. As a result, the toner image was transferred onto the transfer sheet and there was obtained a visible image thereon.

This process of charging, developing and transferring was repeated many times. Even after the number of transferring exceeded 1000, there was found neither deterioration of the master surface nor deterioration of quality of the transferred image. Thereby it was proved that the master is an excellent repeatedly unsable printing master.

Moreover, it was found that the original was faithfully reproduced on the silver grain image and therefore the toner image could be obtained as a faithful photographic image of the original through the electrostatic latent image of good quality corresponding to the silver grain image.

EXAMPLE 3

A number of heat-developable photosensitive sheets were prepared in the same manner and under the same conditions as in Example 1 using, as component material for infrared rays-absorbing layer, various materials shown in the following Table 1.

TABLE 1

| Sample No. | Infrared rays-absorbent | Binder | Ratio by weight of binder to 1 of infrared rays-absorbent | Heat developing time (sec.) |
|---|---|---|---|---|
| 1 | carbon black HAF (Cabot Regal 400R) | octadecylamide | 2 | 25 |
| 2 | same | acetylurethane | 1 | 20 |
| 3 | carbon black FEF | ethyl urea | 1 | 15 |
| 4 | carbon black HAF | polystyrene | 0.5 | 35 |
| 5 | same | polyvinylidene chloride | 0.7 | 20 |
| 6 | iron blue | vinyl acetate | 0.3 | 10 |
| 7 | fast sky blue (Pigment Blue 17, C.I.74180) | ethyl cellulose | 0.2 | 10 |
| 8 | 13-acetoxy-1,1'-diethyl-2,2'-quinotetracarbocyanine iodide | polyvinyl butyral | 0.05 | 50 |
| 9 | a 1:1 (by weight) mixture of phthalocyanine blue (Pigment Blue 15, C.I.74160) and lake orange | polyvinyl pyrolidone | 0.2 | 15 |

Each of the formed samples, Sample Nos. 1 through 9 was mounted on a printing drum made of aluminum and exposed to light through a positive using a tungsten light source (2500 lux) for 15 seconds. Thereafter, heat-developing was carried out with an infrared heating apparatus of 250 W using the heat-developing time given in Table 1 respectively so as to form a printing master.

Immediately after forming the printing master, the process of charging, toner-developing and transferring was carried out in the same manner as in Example 2 to produce on a plane paper sheet (transfer sheet) a transferred visible image. All of the masters formed from the Samples Nos. 1 through 9 produced a very good transferred image respectively which was excellent in sharpness and low in fogging (photographic density of the background of the transferred image corresponding to the non-silver grain image portion of the master). The electrostatic potential contrast between the exposed portions (silver grain image portions) and the unexposed portions (non-silver grain image portions) of the masters was measured, and found to be in the range of from 350 to 450 V. Moreover, on the transfer sheet to which the toner image was transferred, fog density was measured. For all the masters, a very small value of fog density was found which was less than 0.1.

To evaluate the durability of these masters, the above process comprising the steps of charging, developing and transferring was repeated with the use of each the master. Even after repeating the process over 1000 times, there was observed neither deterioration of the master surface nor decrease in quality of the transferred image. Thereby it was proved that these printing masters were excellent in in printing durability as repeatedly usable printing master.

EXAMPLE 4

5 g of graphite powder were dispersed in 95 g of methanol for 3 hours employing a Red-devil dispersing machine.

10 g of the resultant dispersion were introduced into 90 g of polymer solution (supplied by Tomoegawa Paper Mfg. Co., trade name: Oligo Z M-1010, electrically conductive oligomer of anionic sulfone acid salt type) and thoroughly stirred. This mixture was coated onto an art paper 45μ thick with a coating rod (#8) and dried at 80° C. for 5 minutes so that an electrically conductive treatment was effected to the one surface of the paper.

On the back side of the treated surface of the art paper, there was applied an infrared rays-absorbing layer in the thickness of 5μ by coating. The cioating dispersion used for forming the layer was prepared by mixing and dispersing by the ball milling method the following components:

| | |
|---|---|
| 1,1'-diethyl-6,6'-dichloro-4,4'-quinotricarbocyanine iodide | 1 g |
| iron stearate | 1 g |
| dichloroethane | 20 g |

On the infrared rays-absorbing layer, there were further formed an organic silver salt-containing layer and a surface layer which were the same as those in Example 1. Thus, a photosensitive sheet was produced. After subjecting it to a master forming treatment in the same manner as in Example 2, electrostatic printing was carried out. A very good transferred image was obtained.

EXAMPLE 5

As support, a sheet of paper laminated with aluminum was used.

| | |
|---|---|
| Polyvinyl butyral | 4 g |
| Lake Red C (supplied by Dai-Nippon Ink Chemicals Co., Pigment Red 53, 15585) | 20 g |
| ethanol | 150 g |

were ball-milled together and the resultant dispersion was coated onto the laminated paper at the side of aluminum and dried. Thus, an infrared rays-absorbing layer 5μ thick was formed on the support.

To form an organic silver salt-containing layer, 25 g of 80 mol% silver behenate *2,120 g of toluene and 120 g of methyl ethyl ketone were ball-milled for a long time over 72 hours.

*2 refer to *1 described hereinbefore.

Then, 60 g of polyvinyl butyral, BM-1 *3 (as 20 wt% ethyl alcohol solution) and 40 g of ethyl alcohol were added to the above mixture and thoroughly mixed together so as to prepare a polymer dispersion of organic silver salt.

*3 BM-1: trade name, supplied by SEKISUI Kagaku-Kogyo Co., S-Lec B; average polymerization degree: 500–1000 butyralation degree: 62±3 mol% residual acetyl group: less than 3 mol%

To the thus prepared polymer dispersion, there were further added a solution of 120 mg of mercury acetate in 25 ml of methyl alcohol and a solution of 200 mg of calcium bromide in 25 ml of methyl alcohol and mixed together.

Then, the polymer dispersion was coated onto the above infrared rays-absorbing layer in the thickness of 8μ as dried with a coating rod in the dark. Thus, an organic silver salt-containing layer was formed.

1.5 g of 2,2'-methylene-bis-(6-t-butyl-p-cresol), 0.3 g of phtharazinone, 10 g of cellulose acetate, L-30** (as 10 wt% acetone solution) and 30 g of acetone were mixed together to prepare a coating solution for surface layer. The coating solution was coated onto the above organic silver salt-containing layer in the dark as to form a surface layer in the thickness of 4μ as dried. In this manner, a heat-developable photosensitive sheet was produced.

**L-30: trade name, supplied by DAICEL Co., L-AC; average polymerization degree: 150; acetylation degree: 55%

The heat-developable photosensitive sheet was exposed to light for about 20 seconds using a tungsten light source (2500 lux) and irradiated for about 5 seconds with an infrared heatng apparatus composed of a combination of a 1 KW xenon lump (manufactured by Ushio Electric Co.,) and a visible ultraviolet cut filter (manufactured by Toshiba Co.,) so as to produce a visible image. Measurements were conducted on the produced visible image to know the maximum reflection photographic density and fog density (reflection density appearing when the unexposed portion was heated) thereof. It was found that the maximum reflection photographic density was 1.8 and the fog density was 0.12. A good quality visible image with a high sharpness and in pure black tone was obtained and thereby it was proved that the photosensitive sheet is excellent in practical usability.

While the invention has been particularly shown and described with reference to preferred embodiments thereof, it will be understood by those skilled in the art that the foregoing and other changes in form and details can be made therein without departing from the spirit and scope of the present invention.

What we claim is:

1. In the process for forming an electrostatic latent image on an electrostatic printing master by subjecting the printing master to an electric charging treatment, developing the electrostatic latent image thus formed and transferring the developed image onto an image-receiving material, wherein said master is formed by the steps of (A) image wise exposing a heat developable photosensitive member comprising
  (1) a support,
  (2) an organic silver salt layer on said support which contains
    (i) an organic silver salt capable of isolating silver upon reduction, and
    (ii) a silver halide or halogen containing compound which reacts with the organic silver salt to produce silver halide, and
  (3) a reducing agent contained in the silver salt layer or adjacent thereto to reduce the organic silver salt and form a latent image, and (B) heat developing the latent image, the improvement comprising;
  (a) employing an infrared rays absorbing layer between said support and said silver salt layer and
  (b) conducting the step of heat developing the latent image by irradiating the image wise exposed member with infrared rays containing radiation, whereby said infrared rays absorbing layer converts said radiation to heat.

2. Process of claim 1, wherein the infrared rays-absorbing layer is formed by dispersing an infrared rays-absorbent in a binder.

3. Process of claim 2, wherein the binder is a resinous binder having a film forming ability.

4. Process of claim 2, wherein the infrared rays-absorbent is an organic pigment.

5. Process of claim 2, wherein the infrared rays-absorbent is an organic pigment.

6. Process of claim 2, wherein the infrared rays-absorbent is a dyestuff.

7. Process of claim 2, wherein the infrared rays-absorbent is a carbon black.

8. Process of claim 2, wherein the infrared rays-absorbent is a charcoal.

9. Process of claim 2, wherein the mixing ratio by weight of the resinous binder to the infrared rays-absorbent is 0.001–100 of the binder to 1 of the infrared rays-absorbent.

10. Process of claim 2, wherein the mixing ratio by weight of the resinous binder to the infrared rays-absorbent is 0.01–10 of the binder to 1 of the infrared rays-absorbent.

11. Process of claim 2, wherein the average particle size of the infrared rays-absorbent is in the range of from 0.001 to 10μ.

12. Process of claim 11, wherein the average particle size of the infrared rays-absorbent is in the range of from 0.01 to 5μ.

13. Process of claim 1, wherein the thickness of the infrared rays-absorbing layer is in the range of from 0.5 to 30μ.

14. Process of claim 13, wherein the thickness of the infrared rays-absorbing layer is in the range of from 1 to 15μ.

15. Process of claim 13, wherein the thickness of the infrared rays-absorbing layer is in the range of from 1 to 10μ.

16. Process of claim 2, wherein the thickness of the infrared rays-absorbing layer is in the range of from 0.5 to 30μ.

17. Process of claim 16, wherein the thickness of the infrared rays-absorbing layer is in the range of from 1 to 15μ.

18. Process of claim 16, wherein the thickness of the infrared rays-absorbing layer is in the range of from 1 to 10μ.

19. Process of claim 1, wherein there is further provided an intermediate layer in contact with the infrared rays-absorbing layer.

* * * * *

UNITED STATES PATENT AND TRADEMARK OFFICE

CERTIFICATE OF CORRECTION

PATENT NO. : 4,259,424

DATED : March 31, 1981

INVENTOR(S) : ICHIRO ENDO, ET AL.

It is certified that error appears in the above—identified patent and that said Letters Patent is hereby corrected as shown below:

Col. 2, line 26, "calorific" should be --caloric--.
Col. 2, line 40, "such as drum", should be --such as a drum--.
Col. 2, line 46, "such as drum", should be --such as a drum--.
Col. 2, line 56, "characteristics" should be --characteristic--.
Col. 3, line 29, "developably" should be --developable--.
Col. 3, line 38, "enables to use" should be --enables one to use--.
Col. 3, line 60, "at least support" should be --at least a support--.
Col. 5, line 3, "as" should be --so as--.
Col. 5, line 11, "orgaic" should be --organic--.
Col. 5, line 54, "obtain a" should be --obtain--.
Col. 7, line 18, "Movdant" should be --Mordant--.
Col. 7, line 20, "Phodamine" should be --Rhodamine--.
Col. 7, line 57, "Benzale" should be --Bengale--.
Col. 7, line 59, "phloxinde" should be --phloxine--.
Col. 7, line 67, "Victria" should be --Victoria--.
Col. 8, line 12, "Mercocyanine" should be --Merocyanine--.
Col. 8, line 33, "matter" should be --master--.
Col. 8, line 64, "such as support" should be --such as a support--.
Col. 9, line 20, "used" should be --desired--.
Col. 9, line 25, "foming" should be --forming--.
Col. 9, line 40, "contract" should be --contrast--.
Col. 9, line 53, "maybe" should be --may be--.
Col. 9, line 64, "shapable" should be --shapeable--.
Col. 10, line 5, "organic acids" should be --organic acids,--.
Col. 10, line 16, "velerate" should be --valerate--.
Col. 10, line 21, "heptadeylate" should be --heptadecylate--.
Col. 10, lines 22-23, "archidate" should be --arachidate--.
Col. 10, line 30, "undecyanate" should be --undecylate--.
Col. 10, line 45, "acids silver" should be --acids: silver--.
Col. 10, line 47, "thelike" should be --the like--.
Col. 10, line 48, "sulfonic acids silver" should be --sulfonic acids: silver--.

UNITED STATES PATENT AND TRADEMARK OFFICE

CERTIFICATE OF CORRECTION

PATENT NO. : 4,259,424

DATED : March 31, 1981

INVENTOR(S) : ICHIRO ENDO, ET AL.

It is certified that error appears in the above—identified patent and that said Letters Patent is hereby corrected as shown below:

Col. 10, line 51, "sulfinates silver" should be --sulfinates: silver--.
Col. 10, line 53, "carbamates silver" should be --carbamates: silver--.
Col. 11, line 15, "Naphthols" should be -- Napthols: --.
Col. 11, line 20, "polynydroxybenzene" should be --polyhydroxy benzenes:--.
Col. 11, line 23, "Others" should be --Others:--.
Col. 11, line 50, "where in" should be --wherein--.
Col. 13, line 9, "unexpoesed" should be --unexposed--.
Col. 16, line 9, "heatng", should be --heating--.
Col. 18, line 53, "cioating" should be --coating--.
Col. 19, line 27, "500-1000" should be --500-1000;--.
Col. 19, line 28, "mol %", second occurrence, should be --mol %--
Col. 19, line 52, 1KW xenon lump" should be --1KW xenon lamp--.
Col. 20, line 40, Claim 4, "organic pigment" should be --in-organic pigment--.

Signed and Sealed this

*Twenty-second* Day of *September 1981*

[SEAL]

*Attest:*

GERALD J. MOSSINGHOFF

*Attesting Officer*

*Commissioner of Patents and Trademarks*